US010233632B1

(12) United States Patent
Wokutch et al.

(10) Patent No.: US 10,233,632 B1
(45) Date of Patent: Mar. 19, 2019

(54) ROTATABLE STUD FRAMING GUIDE

(71) Applicants: Jason Thomas Wokutch, Fairview, PA (US); Michael Paul, Chicora, PA (US)

(72) Inventors: Jason Thomas Wokutch, Fairview, PA (US); Michael Paul, Chicora, PA (US)

(73) Assignee: Jason Thomas Wokutch, Fairview, PA (US)

( * ) Notice: Subject to any disclaimer, the term of this patent is extended or adjusted under 35 U.S.C. 154(b) by 0 days.

(21) Appl. No.: 15/879,094

(22) Filed: Jan. 24, 2018

Related U.S. Application Data

(63) Continuation-in-part of application No. 29/618,406, filed on Sep. 21, 2017.

(51) Int. Cl.
*E04B 1/26* (2006.01)

(52) U.S. Cl.
CPC .... *E04B 1/2604* (2013.01); *E04B 2001/2616* (2013.01); *E04B 2001/2644* (2013.01)

(58) Field of Classification Search
CPC ..... E04B 1/2604; E04B 2001/2644; E04B 2001/2616; E04B 2001/2612
See application file for complete search history.

(56) References Cited

U.S. PATENT DOCUMENTS 4,261,155 A * 4/1981 Gilb ..... E04B 1/2612 248/282.1

* cited by examiner

*Primary Examiner* — Patrick J Maestri
(74) *Attorney, Agent, or Firm* — Ulmer & Berne LLP

(57) ABSTRACT

A rotatable stud framing guide for aligning a first stud with a second stud includes a base, a rotatable arm, and a lockable retaining pin. The base includes a pair of angle flanges for securing the base to adjacent surfaces along the length of the first stud. The rotatable arm includes compression flanges for securing the rotatable arm to opposing surfaces at the end of the second stud. The lockable retaining pin includes a clevis pin, an eccentric cam lever, and a cotter pin that secures the eccentric cam lever to the clevis pin. The lockable retaining pin passes through pivot holes in the base and rotatable arm to provide an axis of rotation for the rotatable arm and maintain the rotatable arm in proximity to the base. The eccentric cam lever selectively locks the rotatable arm at a desired angle to align the second stud with the first stud.

17 Claims, 8 Drawing Sheets

ROTATABLE STUD FRAMING GUIDE

RELATED APPLICATIONS

This application is a continuation-in-part of U.S. Design application Ser. No. 29/618,406 filed Sep. 21, 2017 which is herein incorporated by reference in its entirety. This application is related to U.S. Design application Ser. No. 29/634,743 filed Jan. 24, 2018.

TECHNICAL FIELD

This application relates generally to a framing guide for use in construction. The application relates more particularly to a guide for positioning studs for framing dwellings and buildings.

BACKGROUND

Modern construction practices utilize wood beams, or studs, that are assembled or preassembled into various configurations to construct the frame of a dwelling or a building. Framing configurations can include structures such as trusses, gables, rafters, joists, sill plates, posts, supports, scaffolding, and so forth. Different sizes and grades of wood can be used depending on the structural necessities of the particular part of a structure being framed. For example, studs such as two-by-fours are commonly used to frame wall sections where the forces are generally vertical, while two-by-six or bigger studs are common for floor joists which have to support substantial horizontal forces as well.

Some configurations utilize wood beams placed at right angles to one another. For example studs used to frame wall sections are generally in horizontal and vertical orientations. These configurations tend to be relatively easy to position and secure to one another as the various surfaces of the studs are also at right angles which facilitates attachment to adjoining beams by nails, screws, and other means. However, other configurations such as trusses and rafters, utilize wood beams positioned at various angles relative to one another, depending upon the specific ways the structure is engineered to carry loads or based on the desired slope of a roof.

SUMMARY

In accordance with an example embodiment of the subject application, a rotatable framing guide includes a base, a rotatable arm, and a lockable retaining pin. The base is configured to be secured to two or more surfaces of a first beam, for example adjacent surfaces of the first beam when the distal ends of the base include 90-degree angle flanges. The rotatable arm is configured to be secured to two or more surfaces at the end of a second beam, for example opposing surfaces of the second beam when the rotatable arm include one or more pairs of compression flanges. The lockable retaining pin is configured to keep the rotatable arm in close proximity to the base, provide an axis of rotation when in an unlocked configuration, and lock the rotatable arm to the base when in a locked configuration. The lockable retaining pin can include a clevis pin, an eccentric cam lever, and a cotter pin configured to secure the eccentric cam lever to the clevis pin. The clevis pin can include am aperture configured to receive the cotter pin, a shaft that configured to pass through the apertures in the base and the rotatable arm, and a head at the top of the shaft that has a larger diameter than the aperture in the rotatable arm and that works in conjunction with the eccentric cam lever to secure the rotatable arm to the base.

In accordance with an example embodiment of the subject application, a framing guide for aligning a first beam with a second beam includes a base, a rotatable arm, and a locking retaining pin. The base includes a center pivot hole and a pair of 90-degree angle flanges at each end. The rotatable arm includes a pivot hole at one end and a set of opposing compression flanges at the other end. The base and rotatable arm are configured to be secured to the first and second beams respectively. The lockable retaining pin secures the rotatable arm to the base, allows rotation of the rotatable arm relative to the base, and selectively locks the rotatable arm at a desired angle relative to the base so as to align the second beam with the first beam.

In accordance with an example embodiment of the subject application, a stud framing guide includes a guide body, and a guide arm extending perpendicularly from the guide body. The guide body includes a two or more angle flanges. Holes in the guide body and angle flanges allow the guide body to be secured along the length of a first stud using suitable fasteners. The guide arm includes two or more opposing flanges configured to hold an end of the second stud in the guide arm. Holes in the guide arm and opposing flanges allow the guide arm to be secured to the end of the second stud using suitable fasteners.

BRIEF DESCRIPTION OF THE DRAWINGS

Various embodiments will become better understood with regard to the following description, appended claims and accompanying drawings wherein:

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

Wood beams, or studs, can be assembled or preassembled into various configurations to construct the frame of a dwelling, a building, or other structures. Studs can be used to construct trusses, gables, rafters, joists, sill plates, posts, supports, scaffolding, and so forth using different sizes and grades of wood to meet structural requirements. Example studs can include two-by-fours, two-by-sixes, two-by-eights, two-by-ten, or bigger studs, as well as four-by-four posts, or larger beams.

While framing vertical walls is relatively straightforward, framing trusses and floor joists can be substantially more difficult. For example, trusses have multiple beams often attached to one another at different angles. For consistency, roof trusses are commonly preassembled, often off-site, and then lifted into position and secured during framing. Floor joists present somewhat different challenges. Floor joists are designed to support substantially more horizontal weight loading than other structures and are often required to span large distances as well. Because of this, floor joists are generally constructed using larger beams, such as two-by-sixes, and two-by-eights. Because of the additional size and weight of the beams used for floor joists, individual beams are positioned and secured into place during framing.

However, precise positioning of individual beams and holding beams in place while securing them during construction can be both difficult and labor intensive. A framing guide can provide both accuracy of placement of the beams and facilitate holding beams in position as they are secured in place.

Figure 1:
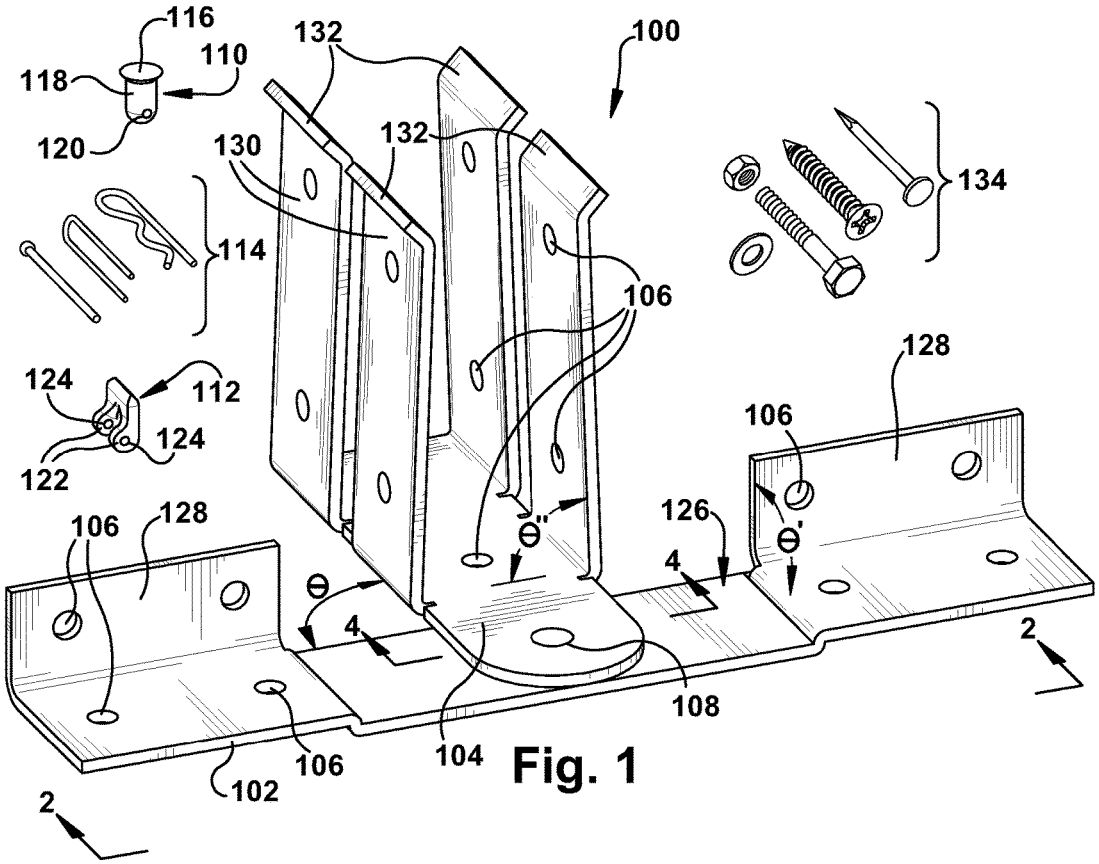
FIG. 1 is a perspective view of an example embodiment of a rotatable stud framing guide.

Referring to FIG. 1, an exemplary rotatable stud framing guide 100 is presented. The rotatable stud framing guide 100 includes a base 102, a rotatable arm 104, and a lockable retaining pin comprising a clevis pin 110, an eccentric cam lever 112, and a cotter pin 114. The clevis pin 110 includes a shaft 118, a head 116 at the top of the shaft 118, and a clevis aperture 120, or pin hole, at the bottom of the shaft 118. The eccentric cam lever 112 includes cam arms 122 configured to straddle the shaft 118 of the clevis pin 110 near the clevis aperture 120. The cotter pin 114 is configured to pass through one of the cam apertures 124, through the clevis aperture 120, and through the other cam aperture 124. The cotter pin 114 can be any suitable shape and configuration that allows eccentric cam lever 112 to rotate relative to the clevis pin 110 about a long axis of the cotter pin 114, for example a pin riveted on both ends, a split pin, or an R-clip as would be understood in the art.

In an unlocked configuration, the lockable retaining pin retains the rotatable arm 104 in close proximity to the base 102 while allowing the rotatable arm 104 to rotate relative to the base 102 about the long axis of the clevis pin 110. In a locked configuration, the eccentric cam lever 112 is rotated so that cams on each of the cam arms 122 press against the base 102, pulling the clevis pin 110 towards the base 102. As the eccentric cam lever 112 is rotated, the head 116 of the clevis pin 110 is pulled towards the rotatable arm 104 until the head 116 contacts the rotatable arm 104. Further rotation of the eccentric cam lever 112 forces the rotatable arm 104 against the base 102 to secure, through friction, the rotatable arm 104 to the base 102 at a desired angle θ.

In a non-limiting example, the angle θ of the rotatable arm 104 relative to the base 102 can be defined as being at 0 degrees when the rotatable arm 104 is normal to, or perpendicular to, the base 102. In this example the rotatable arm 104 can rotate along an arc of approximately 120 degrees and the angle θ varies between approximately −60 degrees and approximately +60 degrees. In other configurations the arc can be greater than or less than 120 degrees and the range of the arc can be dependent, for example, on mechanical constraints such as the angle θ at which part of the rotatable arm 104 contacts the base 102 which inhibits further rotation. Generally, the allowable arc of rotation will be less than 180 degrees, however the arc of rotation presented herein is presented as an example only and is not intended to limit all embodiments of the rotatable stud framing guide 100.

The base 102 can include a center section 126 that includes an aperture 108, or hole, and the shaft 118 of the clevis pin 110 is positioned in the aperture 108 to secure the base 102 to the rotatable arm 104. The rotatable arm 104 similarly includes an aperture 108, or hole, through which the shaft 118 of the clevis pin 110 is positioned. The hole in the rotatable arm 104 can be countersunk and the head 116 can be configured to be seated in the countersunk hole of the aperture 108 such that the top of the head 116 is substantially flush with a top surface of the rotatable arm 104. The center section 126 can be recessed or slightly lower than the distal ends of the base 102 such that the top surface of the rotatable arm 104 is substantially flush, or coplanar, with a top surface of the distal ends of the base 102.

The base 102 can include angle flanges 128 positioned at the distal ends of the base 102. The angle flanges 128 are nominally at a 90-degree angle θ° and configured to abut two adjacent surfaces of a first stud positioned against the base 102 and angle flanges 128. In a configuration, the angle flanges 128 can be suitably sized according to the size of the studs being used. For example, the angle flanges 128 can be approximately the same height as the width of the base 102. In another example, for larger floor joists the height of the angle flanges 128 can be increased to allow multiple attachment points to a stud for additional weight loading capability. In yet another example, the height of the angle flanges 128 and the width of the base 102 can be increased to allow attachment to larger posts.

The rotatable arm 104 can include one or more pairs of opposing compression flanges 130. The compression flanges 130 can be configured such that the angle θ" is less than 90 degrees. In this configuration, when a second stud is placed between the compression flanges 130, the compression flanges 130 press against opposing surfaces on one end of the second stud to hold the second stud in place. This configuration advantageously helps workers by supporting the weight of the second stud and maintaining the second stud in the desired position while the second stud is being secured permanently in position. In this configuration, each of the ends of the compression flanges 130 can include reverse angle flanges 132 angled outwardly from the compression flanges 130. The reverse angle flanges 132 advantageously help workers to insert the second stud between the compression flanges 130 by forcing apart the compression flanges 130 when the second stud is pushed against the reverse angle flanges 132 and the compression flanges 130.

In various configurations, the rotatable arm 104 can include any suitable number of compression flanges 130. For example, the rotatable arm 104 can include a single pair of opposing compression flanges 130, or two or more pairs of opposing compression flanges 130 as illustrated. In yet another example, the rotatable arm 104 can include offset or staggered compression flanges 130 or different numbers of compression flanges 130 on each side of the rotatable arm 104. For example, in one configuration the rotatable arm 104 can include two compression flanges 130 on one side, and a single compression flange 130 on the opposing side. Any suitable arrangement of compression flanges 130 can be used to increase strength, decrease weight or materials costs, or for aesthetic or marketing reasons.

A plurality of apertures 106, or holes, allow workers to permanently secure the first stud and second stud to the rotatable stud framing guide 100 using fasteners 134 such as wood screws, bolts and nuts, nails, or other suitable fasteners. The base 102, the angle flanges 128, the rotatable arm 104, and the compression flanges 130 can all include apertures 106. In an embodiment, the apertures 106 can be offset from one another so that the fasteners 134 do not intersect with other fasteners 134 when inserted into the studs. For example, if bolts are used as the fasteners 134, then holes in the base 102 and angle flanges 128 may need to be offset from another. In another example, if bolts are used as the fasteners 134, then holes can be aligned in opposing compression flanges 130 to allow a single bolt to pass through the stud and both of the compression flanges 130. Any suitable configuration of offset apertures 106 or aligned apertures 106 can be used as would be understood in the art.

Figure 2:
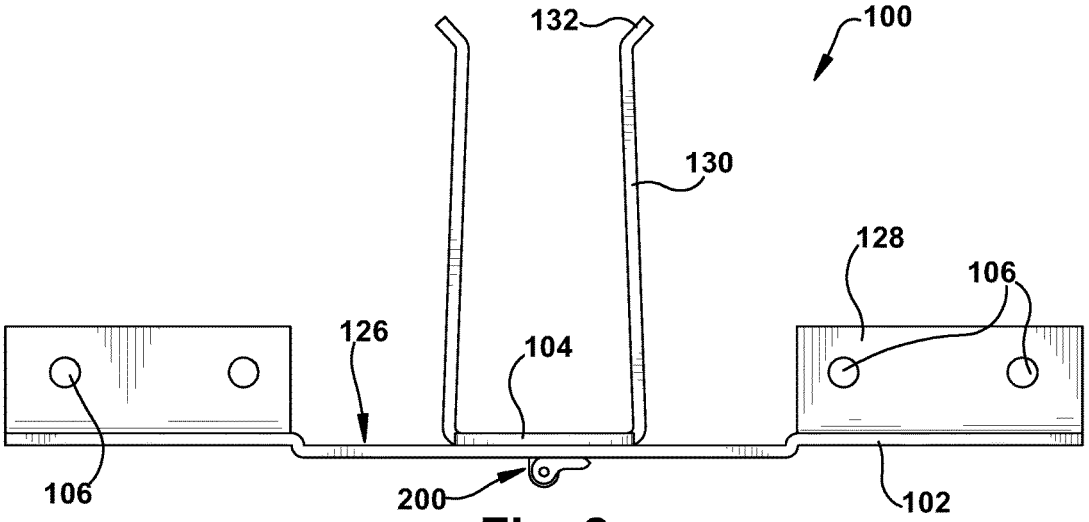
FIG. 2 is a front view of the rotatable stud framing guide of FIG. 1.

Referring to FIG. 2, a front view of the rotatable stud framing guide 100 of FIG. 1 is presented including the base 102, center section 126, angle flanges 128, rotatable arm 104, compression flanges 130, reverse angle flanges 132, apertures 106, and the assembled lockable retaining pin 200. The assembled lockable retaining pin 200 functions as a rotatable locking mechanism to selectively secure the rotatable arm 104 to the base 102 at the desired angle. In this view, the assembled lockable retaining pin 200 is in the locked position.

Figure 3:
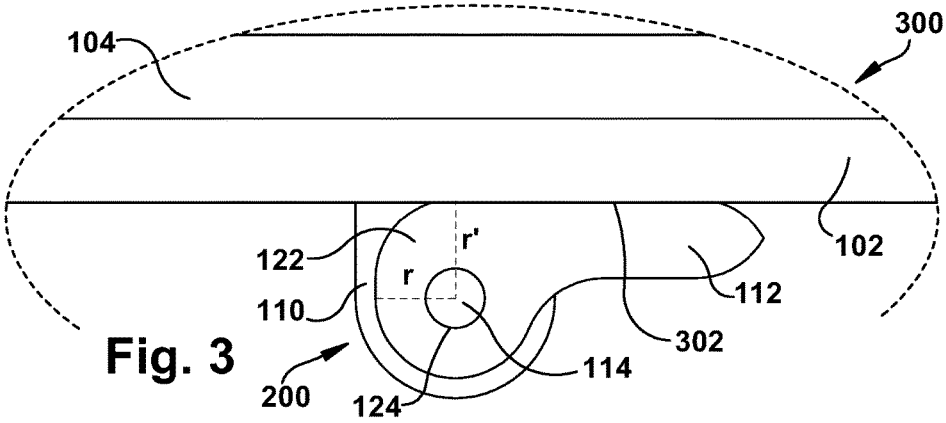
FIG. 3 is close up view of an example embodiment of a rotatable locking mechanism of the rotatable stud framing guide of FIG. 1.

Referring to FIG. 3, a close up view 300 of the rotatable locking mechanism of the rotatable stud framing guide of FIG. 2 is presented. Portions of the assembled lockable retaining pin 200 are illustrated including the clevis pin 110, the eccentric cam lever 112, and the cotter pin 114 which has been inserted through a cam aperture 124 of the eccentric cam lever 112. The cam arm 122 of the eccentric cam lever 112 has a longer radius r' near the flat edge 302 of the eccentric cam lever 112, and a shorter radius r for other portions of the cam arm 122 that decreases as one moves further away from the flat edge 302. When the eccentric cam lever 112 is in the locked position, the eccentric cam lever 112 is configured so that the flat edge 302 is substantially flush with the bottom surface of the base 102. Advantageously, when eccentric cam lever 112 is in the locked configuration, having the flat edge 302 flush against the base 102 substantially reduces the likelihood that the eccentric cam lever 112 could be accidentally struck and forced into the unlocked position which would allow the rotatable arm 104 to rotate unexpectedly.

Figure 4:
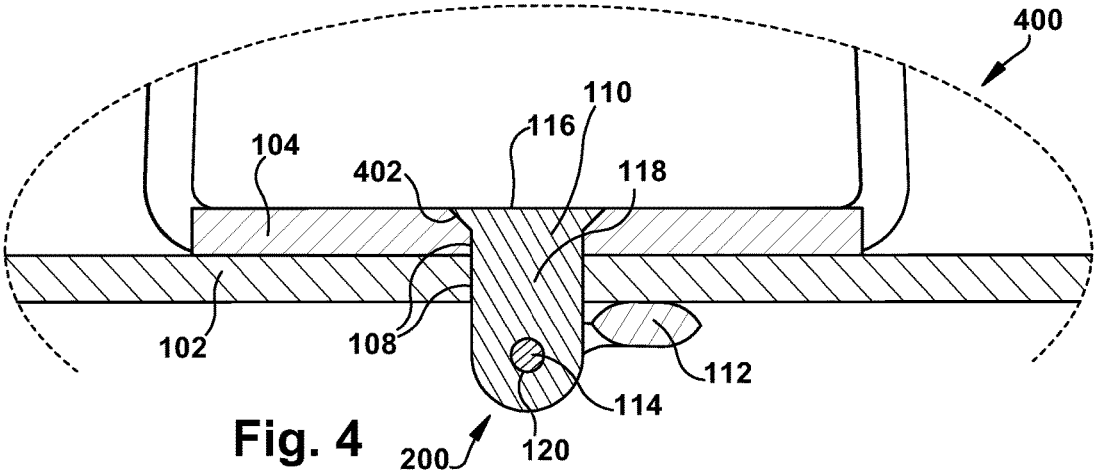
FIG. 4 is a cutaway view of the rotatable locking mechanism of FIG. 3.

Referring to FIG. 4, a cutaway view 400 of the rotatable locking mechanism of the rotatable stud framing guide of FIG. 3 is presented. Portions of the assembled lockable retaining pin 200 are illustrated including the clevis pin 110, the eccentric cam lever 112, and the cotter pin 114 which has been inserted through the clevis aperture 120 of the eccentric cam lever 112. The shaft 118 of the clevis pin 110 passes through the locking aperture 108 of the rotatable arm 104 and base 102. The clevis pin 110 includes a tapered head 116 that seats flush against a tapered portion 402 of the locking aperture 108 of the rotatable arm 104.

Figure 5:
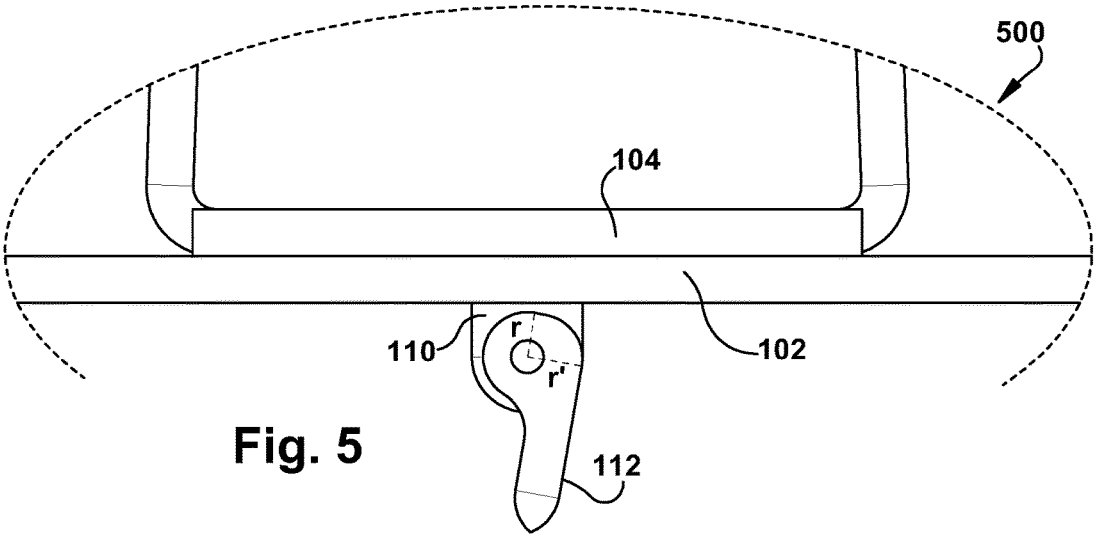
FIG. 5 is a close up view the rotatable locking mechanism of FIG. 3 in an unlocked configuration.

Referring to FIG. 5, a close up view 500 of the rotatable locking mechanism of the rotatable stud framing guide of FIG. 2 is presented. In this view 500, the eccentric cam lever 112 is in the unlocked position. In this configuration, the cam arm 122 of the eccentric cam lever 112 nearest to the base has a shorter radius r than the radius r' near the flat edge of the eccentric cam lever 112. As a result of the shorter radius r, the eccentric cam lever 112 does not exert force against the base 102 and the rotatable arm 104 is free to rotate relative to the base 102. Advantageously, when the eccentric cam lever 112 is in the unlocked configuration, the eccentric cam lever 112 is easily accessible by a worker for rotation into the locked configuration.

Figure 6:
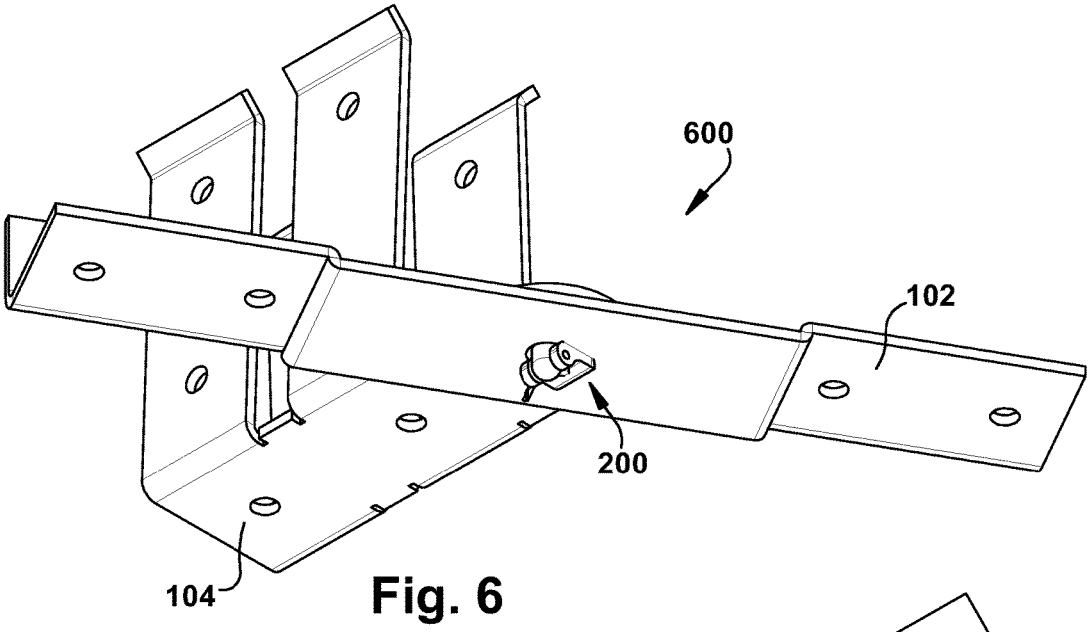
FIG. 6 is a bottom perspective view of the rotatable stud framing guide of FIG. 1.

Referring to FIG. 6, a bottom perspective view 600 of the rotatable stud framing guide of FIG. 1 is presented. In this view, the lockable retaining pin 200 is in a locked configuration and the rotatable arm 104 is secured against the base 102.

Figure 7:
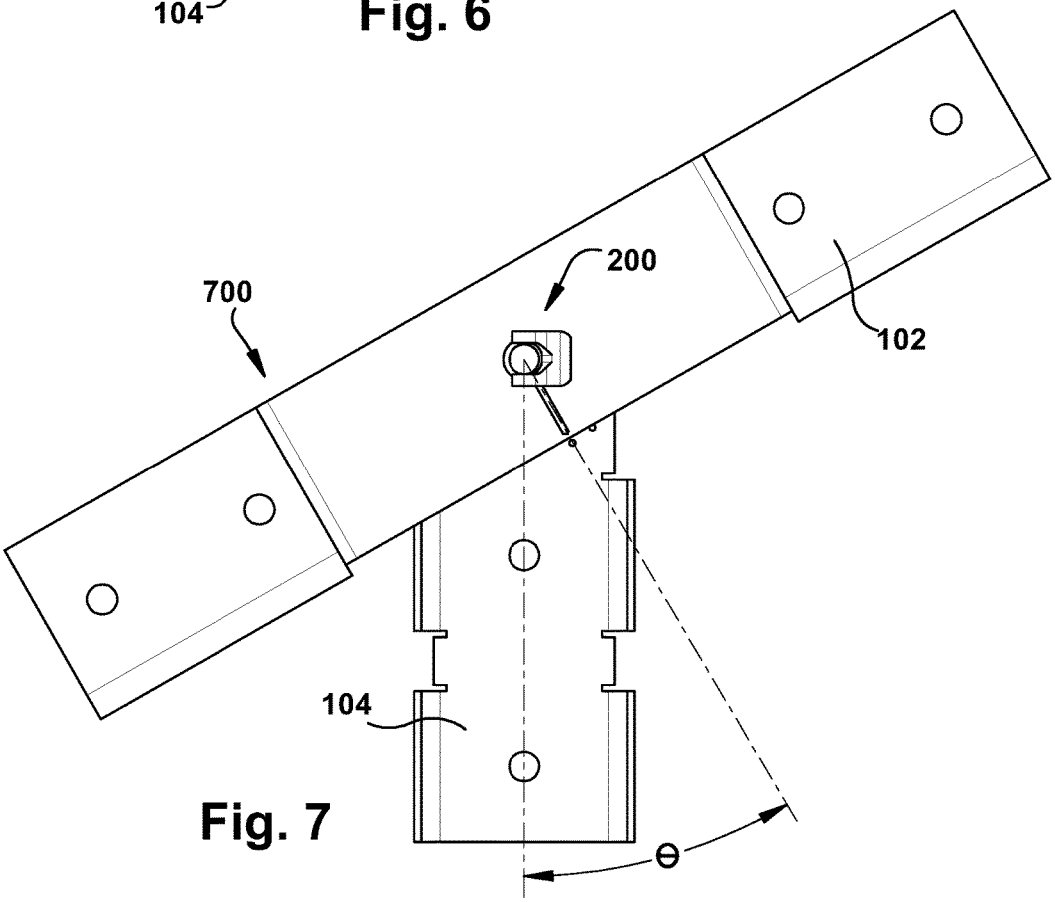
FIG. 7 is a bottom view of the rotatable stud framing guide of FIG. 1.

Referring to FIG. 7, a bottom view 700 of the rotatable stud framing guide of FIG. 1 is presented. In this bottom view 700, the rotatable arm 104 is locked at an angle θ to the base 102.

Figure 8:
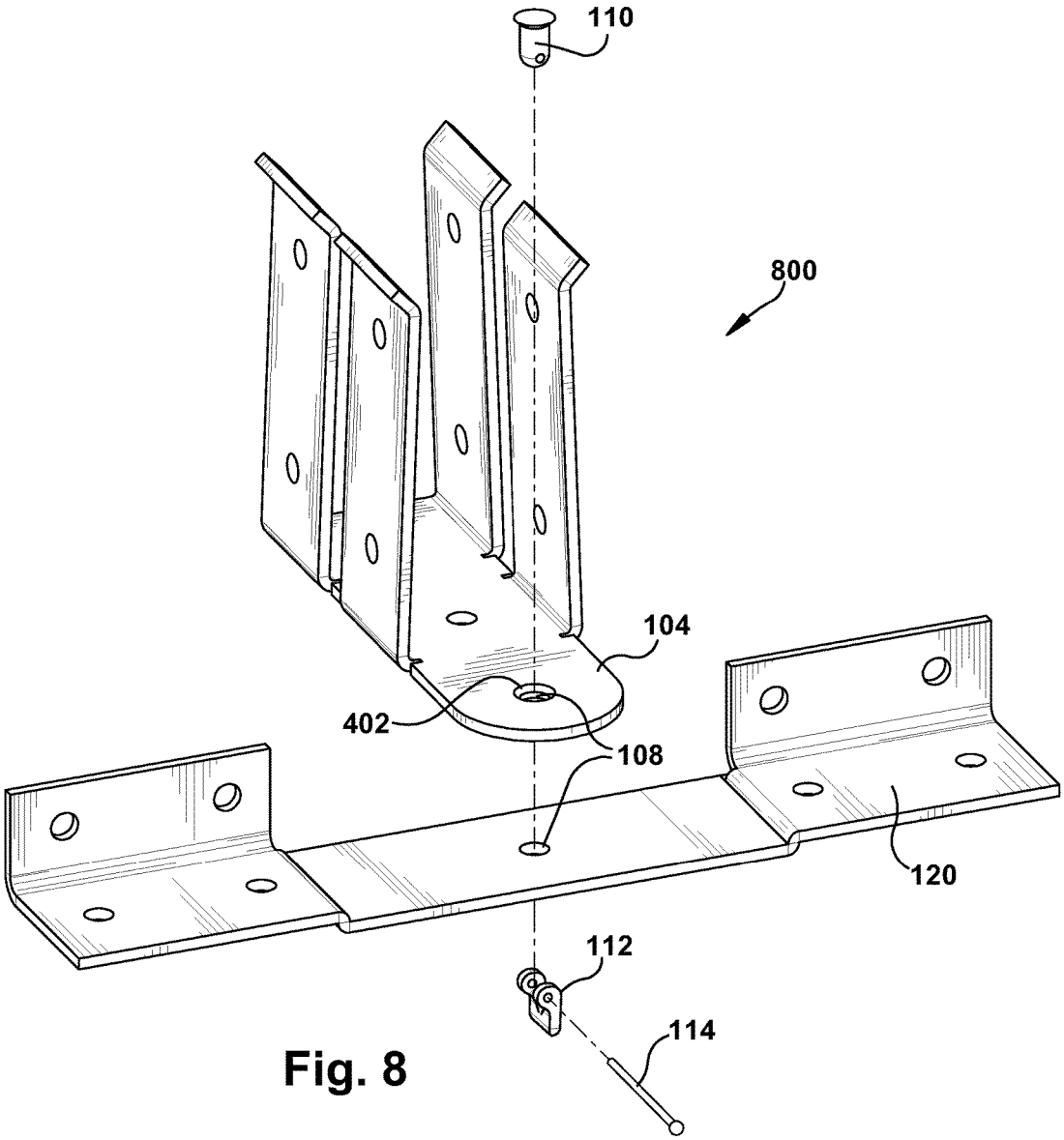
FIG. 8 is an exploded view of the rotatable stud framing guide of FIG. 1 in a rotated configuration.

Referring to FIG. 8, an exploded view 800 of the rotatable stud framing guide of FIG. 1 is presented. In this exploded view 800, the tapered portion 402 of the locking aperture 108 of the rotatable arm 104 is visible. To assemble the rotatable stud framing guide, the clevis pin 110 is inserted through both locking apertures 108 of the rotatable arm 104 and base 102, and a cotter pin 114 is inserted through the eccentric cam lever 112 and clevis pin 110.

Figure 9:
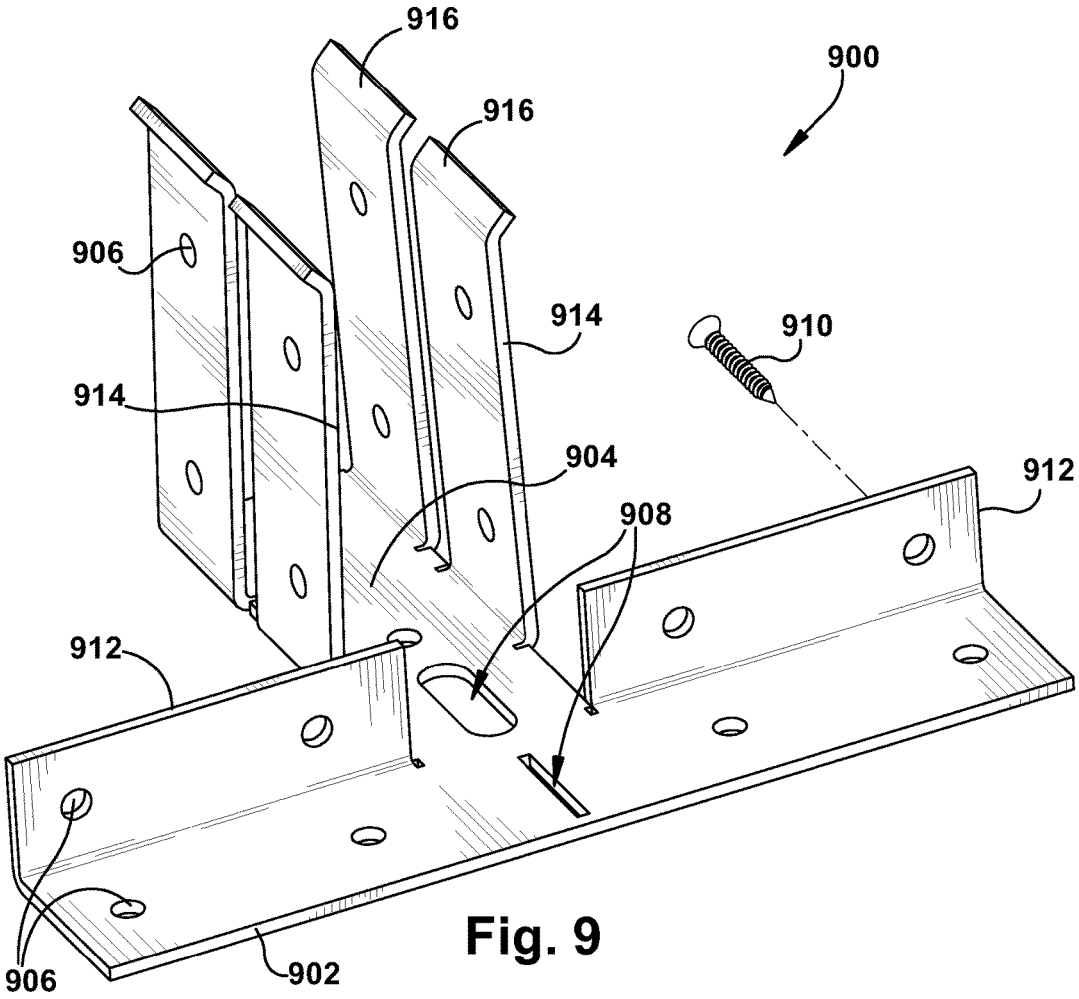
FIG. 9 is a perspective view of an example embodiment of a stud framing guide.
Figure 10:
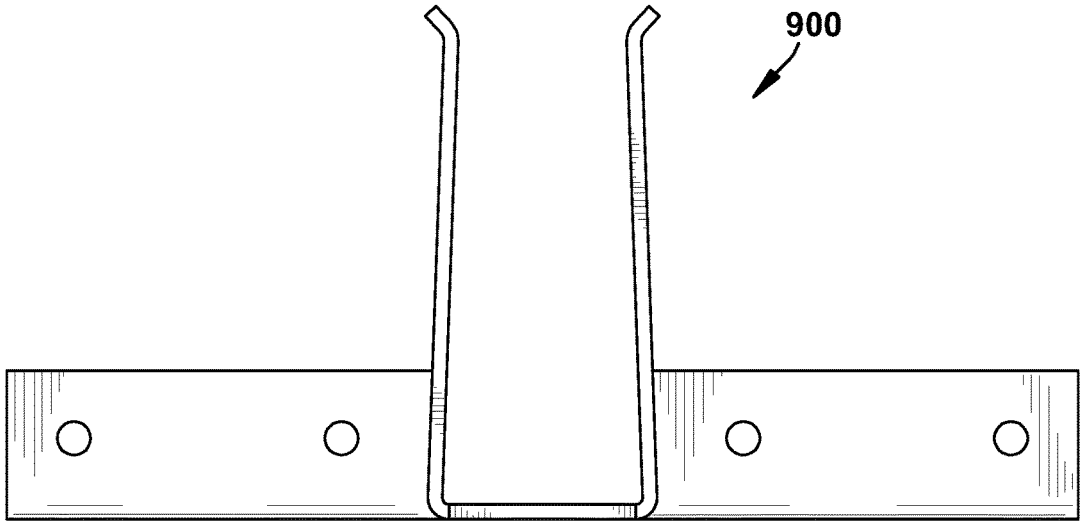
FIG. 10 is a rear view of the stud framing guide of FIG. 9.
Figure 11:
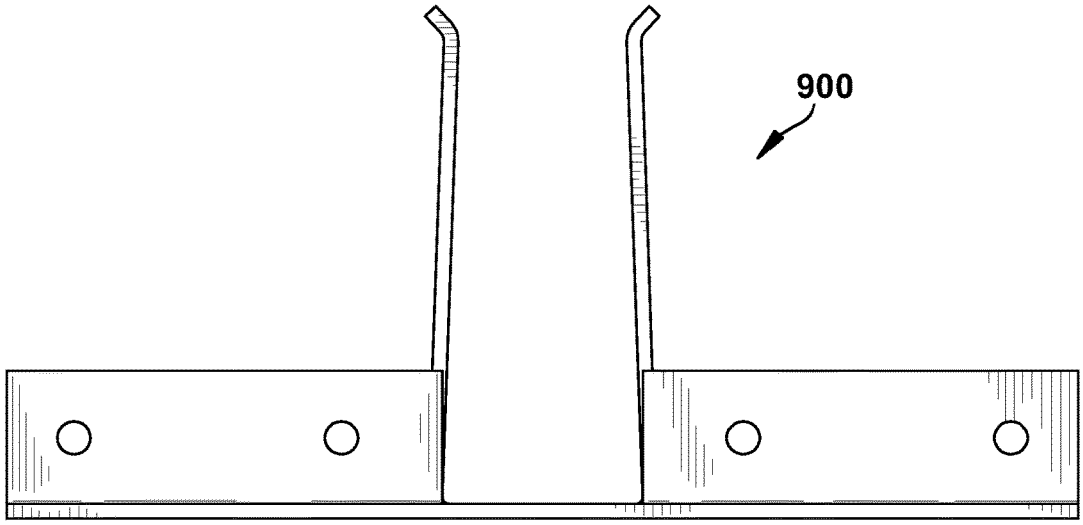
FIG. 11 is a front view of the stud framing guide of FIG. 10.
Figure 12:
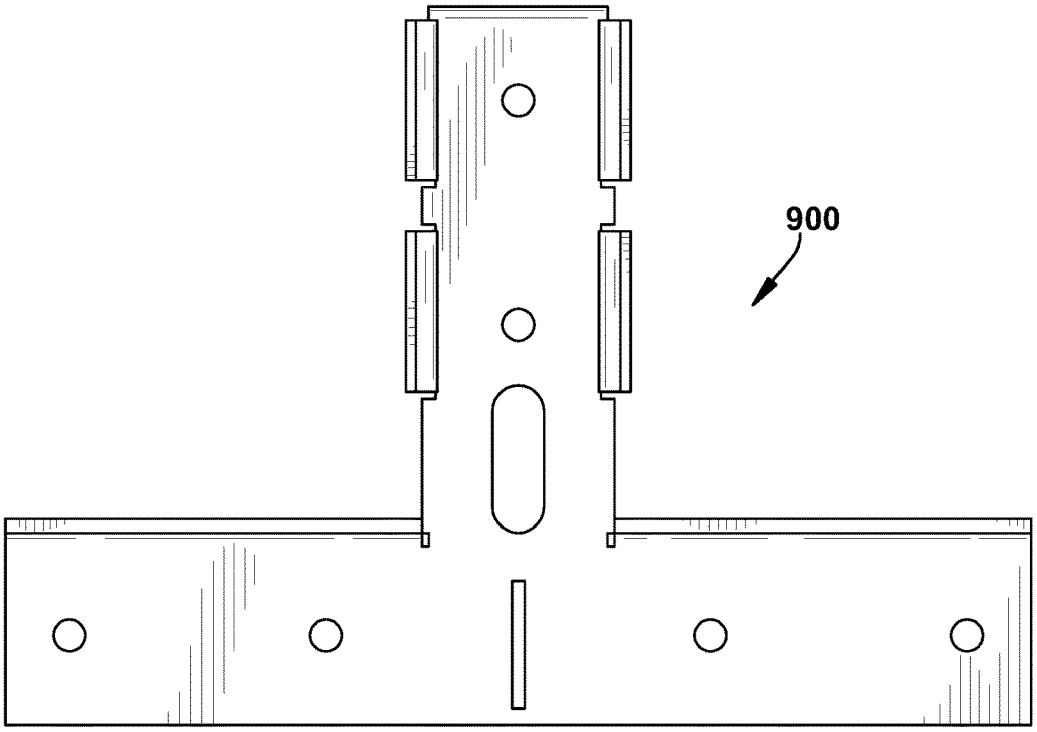
FIG. 12 is a top view of the stud framing guide of FIG. 9.
Figure 13:
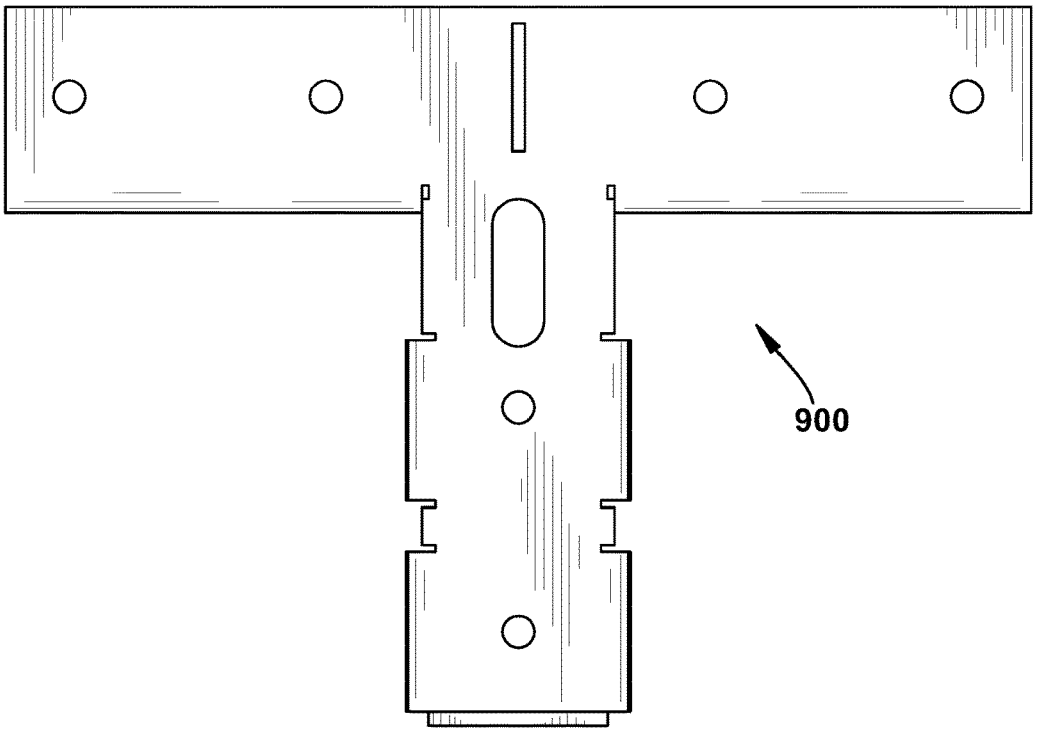
FIG. 13 is a bottom view of the stud framing guide of FIG. 9.
Figure 14:
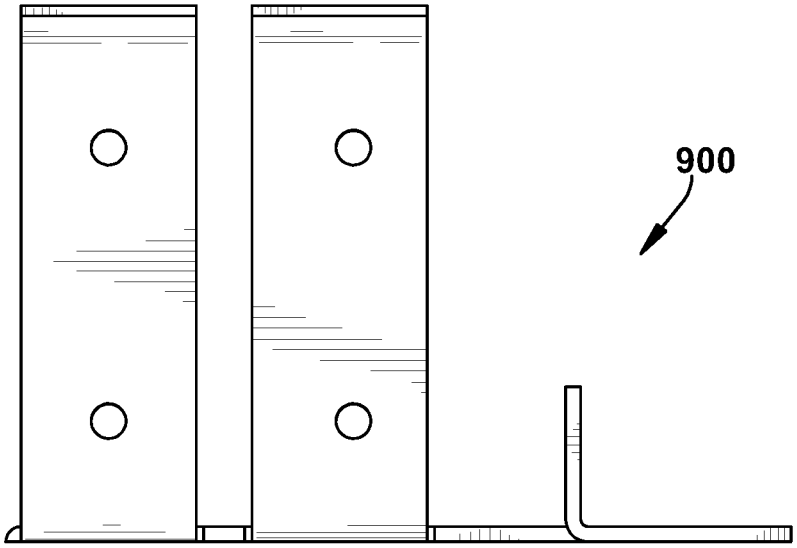
FIG. 14 is a left side view of the stud framing guide of FIG. 9.
Figure 15:
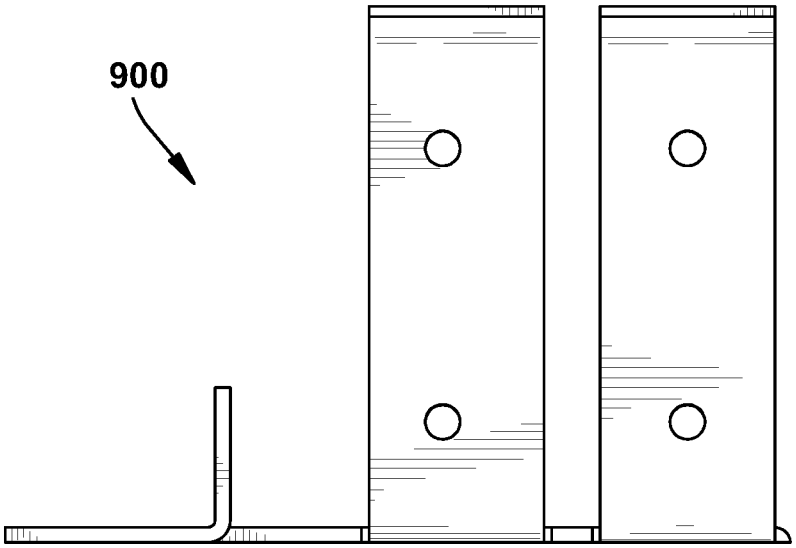
FIG. 15 is a right side view of the stud framing guide of FIG. 9.

Referring to FIG. 9 a perspective view of a stud framing guide 900 is presented. The stud framing guide 900 includes a guide body 902 and a guide arm 904 connected to the center of the guide body 902. The guide body 902 includes two angle flanges at the distal ends of the guide body rotated at right angles, or 90-degrees, relative to the guide body. The guide body 902 and angle flanges are configured to abut adjoining surfaces of a first stud. The guide arm 904 includes one or more pairs of compression flanges. The top of each compression flange can include a reverse angle flanges to assist a worker with inserting the end of a second stud between the compression flanges into the guide arm 904. Fasteners, such as wood screws, can be inserted through apertures in the guide body 902, guide arm 904, angle flanges, and compression flanges into the studs to permanently secure the studs to the stud framing guide 900. Viewing apertures 908 can assist a worker with alignment of the stud framing guide 900 and the studs. The viewing apertures 908 can be used to apply marks to the studs.

The stud framing guide 900 can be constructed from a single flat piece of metal of suitable thickness by first cutting the metal into the appropriate shape and then bending portions of the metal to make the angle flanges, compression flanges, and reverse angle flanges. The apertures 906 and viewing apertures 908 can be drilled or milled prior to bending the portions of the metal into shape.

FIGS. 10-15 illustrate a rear view, a front view, a top view, a bottom view, a left side view, and a right side view respectively of the stud framing guide 900 of FIG. 9.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the spirit and scope of the inventions.

What is claimed is:

1. A rotatable framing guide, comprising:

a base configured to be secured to at least two different surfaces of a first beam;

a rotatable arm configured to be secured to at least two different surfaces of a second beam; and a lockable retaining pin configured to connect the rotatable arm to the base, provide an axis for the rotatable arm to rotate relative to the base when in an unlocked configuration, rotatably lock the rotatable arm to the base when in a locked configuration; and wherein the lockable retaining pin includes, a clevis pin including a shaft configured to pass through a locking aperture in the base and through a locking aperture in the rotatable arm, a head at the top of the shaft having a diameter greater the locking aperture, and an aperture at the base of the shaft configured to receive a cotter pin;

an eccentric cam lever secured to the clevis pin by the cotter pin and configured to rotate relative to a long axis of the clevis pin from an unlocked configuration to a locked configuration; and a cotter pin configured to secure the eccentric cam lever to the clevis pin.

2. The rotatable framing guide of claim 1, wherein rotation of the eccentric cam lever from the unlocked configuration to the locked configuration forces the rotatable arm into contact with the base.

3. The rotatable framing guide of claim 2, wherein when the eccentric cam lever is in the locked configuration static friction between the rotatable arm and the base inhibits rotation of the rotatable arm relative to the base.

4. The rotatable framing guide of claim 1, wherein the base includes a plurality of apertures that are each configured to receive a fastener for securing the first beam to the base, and wherein the rotatable arm includes a plurality of apertures that are each configured to receive a fastener for securing the second beam to the rotatable arm.

5. The rotatable framing guide of claim 4, further comprising a plurality of fasteners, wherein each fastener is selected from the group consisting of a screw, a bolt and nut, and a nail.

6. The rotatable framing guide of claim 1, wherein the base includes two ends, and, at each end, flanges turned at right angles relative to each end and coaxial to the long axis of the base, wherein each end and each flange includes a plurality of apertures, and wherein the apertures of the ends and the apertures of the flanges are configured to be positioned next to adjacent surfaces of the first beam.

7. The rotatable framing guide of claim 6, wherein the base further includes a locking aperture positioned in a center section of the base and configured to receive the lockable retaining pin.

8. A rotatable framing guide, comprising:

a base configured to be secured to at least two different surfaces of a first beam, wherein the base includes, two ends, each end including flanges turned at right angles relative thereto each end and coaxial to the long axis of the base, wherein each end and each flange includes a plurality of apertures, and a locking aperture positioned in a center section of the base and configured to receive a lockable retaining pin; and a rotatable arm configured to be secured to at least two different surfaces of a second beam; wherein the lockable retaining pin is configured to connect the rotatable arm to the base, provide an axis for the rotatable arm to rotate relative to the base when in an unlocked configuration, rotatably lock the rotatable arm to the base when in a locked configuration wherein the locking aperture is a countersunk locking aperture and wherein a top of the lockable retaining pin is configured to be flush with the base when seated in the countersunk locking aperture.

9. A rotatable framing guide, comprising:

a base having two ends, the base configured to be secured to at least two different surfaces of a first beam, wherein the base includes, at each end flanges turned at right angles relative thereto and coaxial to the long axis of the base, wherein each end and each flange includes a plurality of apertures, and wherein the apertures of the ends and the apertures of the flanges are configured to be positioned next to adjacent surfaces of the first beam, and a locking aperture positioned in a center section of the base and configured to receive a lockable retaining pin, wherein the center section is recessed such that a top surface of the rotatable arm is coplanar with a top surface of the ends of the base; and a rotatable arm configured to be secured to at least two different surfaces of a second beam; wherein the lockable retaining pin is configured to retain the rotatable arm connected to the base, provide an axis for the rotatable arm to rotate relative to the base when in an unlocked configuration, rotatably lock the rotatable arm to the base when in a locked configuration.

10. The rotatable framing guide of claim 1, wherein the rotatable arm is configured to rotate through an angle of approximately −60 degrees to approximately +60 degrees relative to the long axis of the base.

11. A rotatable framing guide, comprising:

a base configured to be secured to at least two different surfaces of a first beam;

a rotatable arm configured to be secured to at least two different surfaces of a second beam; and a lockable retaining pin configured to connect the rotatable arm to the base, provide an axis for the rotatable arm to rotate relative to the base when in an unlocked configuration, rotatably lock the rotatable arm to the base when in a locked configuration; and wherein the rotatable arm includes a flat portion having a locking aperture positioned at one end that is configured to receive the lockable retaining pin, and a flange turned at an angle relative to the flat portion and running coaxial to the long axis of the rotatable arm, wherein each flange includes a plurality of apertures configured to abut surfaces on opposite sides of the second beam.

12. The rotatable framing guide of claim 11, wherein the rotatable arm further includes a plurality of apertures positioned in the flat portion and configured to abut a surface of the second beam adjacent to each of the opposite sides of the second beam.

13. The rotatable framing guide of claim 11, wherein each flange includes a second smaller flange at an end of each flange configured to facilitate insertion of the second beam into the rotatable arm.

14. The rotatable framing guide of claim 13, wherein each flange is turned at an angle greater than normal to the flat portion such that flanges on opposite sides of the rotatable arm are closer together at the ends than near the flat portion of the rotatable arm so as to facilitate retention of the second beam in the rotatable arm.

15. A framing guide for aligning a first beam and a second beam, comprising:

a base including a center pivot hole and a 90-degree angle flange at each end of the base configured to abut the first beam;

a rotatable arm including a pivot hole at one end of the rotatable arm and a set of opposing compression flanges configured to accept the second beam;

a lockable retaining pin configured to secure the rotatable arm to the base, facilitate rotation of the rotatable arm relative to the base about a long axis of the lockable retaining pin, and selectively lock the rotatable arm at a desired angle to the base for aligning the second beam relative to the first beam; and wherein the lockable retaining pin further includes, a clevis pin including a shaft, a head positioned at the top of the shaft, and a through hole at the base of the shaft configured to receive a cotter pin;

a cam lever having two arms with through holes, the cam lever configured to selectively rotate an eccentric cam against the base to lock the rotatable arm at the desired angle; and a cotter pin configured to pass through the through holes in the two arms of the cam lever and the through hole in the clevis pin to secure the cam lever to the clevis pin, and wherein the cotter pin is configured to provide an axis of rotation for the cam lever relative to the clevis pin.

16. The framing guide of claim 15, wherein the rotatable arm further comprises a second set of opposing compression flanges.

17. The framing guide of claim 15, further comprising:

a plurality of holes in the base, each 90-degree angle flange, the rotatable arm, and the compression flanges; and a plurality of fasteners configured to secure the first beam to the base and the second beam to the rotatable arm, wherein each fastener is selected from the group consisting of a screw, a bolt and nut, and a nail.

* * * * *